US005462188A

United States Patent [19]

Yurgevich

[11] Patent Number: 5,462,188

[45] Date of Patent: * Oct. 31, 1995

[54] INTEGRATED INTERBOX CONNECTORS

[75] Inventor: Howard J. Yurgevich, Monticello, Ind.

[73] Assignee: Rosby Corporation, Monon, Ind.

[ * ] Notice: The portion of the term of this patent subsequent to Sep. 13, 2011 has been disclaimed.

[21] Appl. No.: 165,440

[22] Filed: Dec. 10, 1993

Related U.S. Application Data

[63] Continuation-in-part of Ser. No. 49,838, Apr. 19, 1993, Pat. No. 5,346,084.

[51] Int. Cl.[6] ..... B65D 7/26; B65D 21/02

[52] U.S. Cl. ..... 220/1.5; 206/511; 206/512

[58] Field of Search ..... 220/1.5; 206/506, 206/512, 511

[56] References Cited

U.S. PATENT DOCUMENTS 3,011,749 12/1961 Kozak .
3,083,670 4/1963 Harlander et al. .
3,085,707 4/1963 Tantlinger .
3,752,511 8/1973 Racy .
3,973,684 8/1976 Di Martino .
4,186,841 2/1980 Buckley et al. .
4,648,764 3/1987 Pavlick .
5,014,867 5/1991 Van Melle .
5,022,546 6/1991 Bock .
5,067,013 11/1991 Lindholm et al. .

*Primary Examiner*—Joseph M. Moy
*Attorney, Agent, or Firm*—Locke Reynolds

[57] ABSTRACT

An integrated interbox connector to permit vertical stacking of cargo carriers includes a plate movably connected to the carrier and positionable between in a stored position situated within a wall of the carrier and a connecting position situated on top of the roof of the carrier, the plate carrying a lug for engaging interlocking apertures provided on the bottom of a vertically adjacent cargo carrier. The lug can be secured to the interlocking aperture by a pin engaging a hole in a fixed lug or by a tab causing rotation of a rotatable lug.

20 Claims, 11 Drawing Sheets

INTEGRATED INTERBOX CONNECTORS

CROSS-REFERENCE TO RELATED APPLICATION

The present application is a continuation-in-part of U.S. application Ser. No. 08/049,838 filed Apr. 19, 1993 now U.S. Pat. No. 5,346,084.

BACKGROUND OF THE INVENTION

The present invention relates to cargo carrying containers suitable for use in multi-mode transportation of freight or cargo by ship, rail, or overland truck. Examples of intermodal cargo containers are found in U.S. Pat. Nos. 3,085,707; 3,646,609; 4,212,405; 4,844,672; and, 5,205,428.

Intermodal cargo containers generally are constructed to certain standard dimensions and have structural features that minimize handling problems and allow for the stacking of containers, particularly when used in a ship or rail mode. Certain changes in overall width, length and height have been adopted from time-to-time for certain newer style containers, but such changes in overall dimension have only been made in such a manner to accommodate stacking arrangements with older style containers. For example, the intermodal containers constructed as disclosed in U.S. Pat. No. 3,085,707 were built at a standard length of 40 feet. The containers of U.S. Pat. No. 3,646,609 were intended to be longer than 40 feet in length, but were fitted on top and bottom with an intermediate set of castings which are connected together with a structural frame to allow the longer containers to be stacked and lifted at these intermediate points. The required thickness of the floor of the container necessary to bear the load is generally sufficient to enclose the castings which are employed on the bottom of the container for stacking purposes. On the other hand, the intermediate castings which are situated at the top of the containers as disclosed in U.S. Pat. No. 3,646,609 are considerably larger than either the thickness of the wall or roof and thus intrude into the cargo area of the container. This intrusion into the cargo area of the intermediate top castings has many disadvantages, and attempts have been made to reduce or eliminate this intrusion.

Certain newer containers which have sought to maximize the inside height, such as that disclosed in U.S. Pat. No. 5,205,428, have avoided this intrusion by eliminating the intermediate top casting which would permit stacking and replaced it with a side lift design intended to interact with either pin or wedge type handling devices. Such handling devices still maintain the existing lifting locations at the 40 foot apart intermediate lift points of the containers, but do not permit stacking at these locations. As such, these units can generally only be included in a stack of containers as the top unit thus reducing the flexibility of the unit and creating certain logistics problems for operators of intermodal container terminals.

One means of solving this problem is to create a stacking frame at each extreme end of the container and install conventional stacking castings to allow interlocking of the units together using conventional interbox connectors. However, when this is done, the stacking castings again intrude into the top of the cargo area at the front and rear corners. Such intrusion has the effect of reducing the usable inside length of such a container by as much as 12 inches which is not desirable. The present invention is an alternative solution which avoids any substantial intrusion into the enclosed cargo area while at the same time permitting the container to be situated at any point in a stack of longer containers.

SUMMARY OF THE INVENTION

An intermodal cargo container of the present invention comprises generally a space enclosing structure including a floor, a roof, a pair of parallel side walls, and first and second end walls, respectively, connected between the side walls with at least one of either of the side walls or end walls defining an opening to permit entry and exit of cargo. The intermodal container further comprises integrated interbox connectors movably connected to the container and positionable in either a stored position situated within the space enclosing structure of the container or a connecting position situated on top of the roof of the container. The intermodal cargo container also comprises securing means for securing the interbox connectors in the stored position which are also employed to secure the interbox connectors to a vertically adjacent container when the interbox connectors are situated in the connecting position.

In a first preferred embodiment, the integrated interbox connectors each comprise a plate movably connected to the intermodal cargo container. A positioning opening is provided in the roof of the container and a positioning lug is fixed to the movable plate to be received in the positioning opening to define a connecting position for the plate when situated on top of the roof of the container. A projecting lug is fixed to an opposite side of the plate and adapted to project upward into a confronting interlocking aperture of a vertically adjacent container when the plate is in the connecting position. At least one opening is provided in the projecting lug. A pin is insertable through an opening in a vertically adjacent container and into one of the openings in the projecting lug for securing the projecting lug to the interlocking aperture provided on the bottom of the vertically adjacent container. A chamber is provided in the walls of the container for receiving the positioning lug and the plate when moved to the stored position. The pin used to secure the projecting lug to the interlocking aperture can be employed to lock the projecting lug in a stored position within the container wall.

In a second embodiment of the invention, the apparatus includes a plate, connecting means for movably connecting the plate to the cargo carrier top to permit displacement of the plate between in a stored position situated within a wall of the carrier and a connecting position situated on top of the carrier, a rotatable projecting lug rotatable with respect to the plate between an unlocked position aligned with an interlocking aperture of a vertically adjacent cargo carrier and a locked position anti-aligned with said interlocking aperture of said vertically adjacent carrier, and rotation means for rotating the rotatable projecting lug between said positions. The rotation means takes the form of a rotation pin fixed to the projecting lug and extending through the plate, a positioning gear fixed to the rotation pin, and a locking tab having a slot including a cog for engaging the positioning gear, the locking tab being slidably received around the rotation pin. A collar is fixed to the plate which spaces the rotatable projecting lug from the plate, the rotation pin extending through the collar, and restricting means situated within the collar for restricting the movement of the rotation pin. The restricting means can consist of a groove in an outer surface of said rotation pin and a projecting element biased into the groove by a spring situated within the collar.

Preferably, the plate of the integrated interbox connector is pivoted to the container by hinge elements fixed to the plate and container and a hinge pin coupling the hinge elements together. Thus, the integrated interbox connectors are retractable and self-contained within the external geometry of the container yet have the advantage of being designed to retract in such a manner as to minimize the loss of inside length while providing no cargo area intrusion. A further advantage of this design is that the interbox connectors can no longer be lost or stolen when not in use which is common with current apparatus which utilizes separate loose interbox connectors which are typically stored in open containers on the rail car or at the intermodal container terminal. The integrated interbox connectors of the present invention have the added advantage of being less heavy to handle and also cannot drop or fall from the top of a container thus reducing the hazard to handlers of such containers. Additionally, the integrated interbox connectors of the present invention can be employed at the top of any cargo carrier including trailers constructed with a stacking frame or similar structure so as to withstand the stacking forces.

Other features and advantages of the present invention will become apparent to those skilled in the art upon consideration of the following detailed description of a preferred embodiment exemplifying the best mode of carrying out the invention as presently perceived. The detailed description particularly refers to the accompanying figures.

DESCRIPTION OF THE PREFERRED EMBODIMENT

Figure 1:
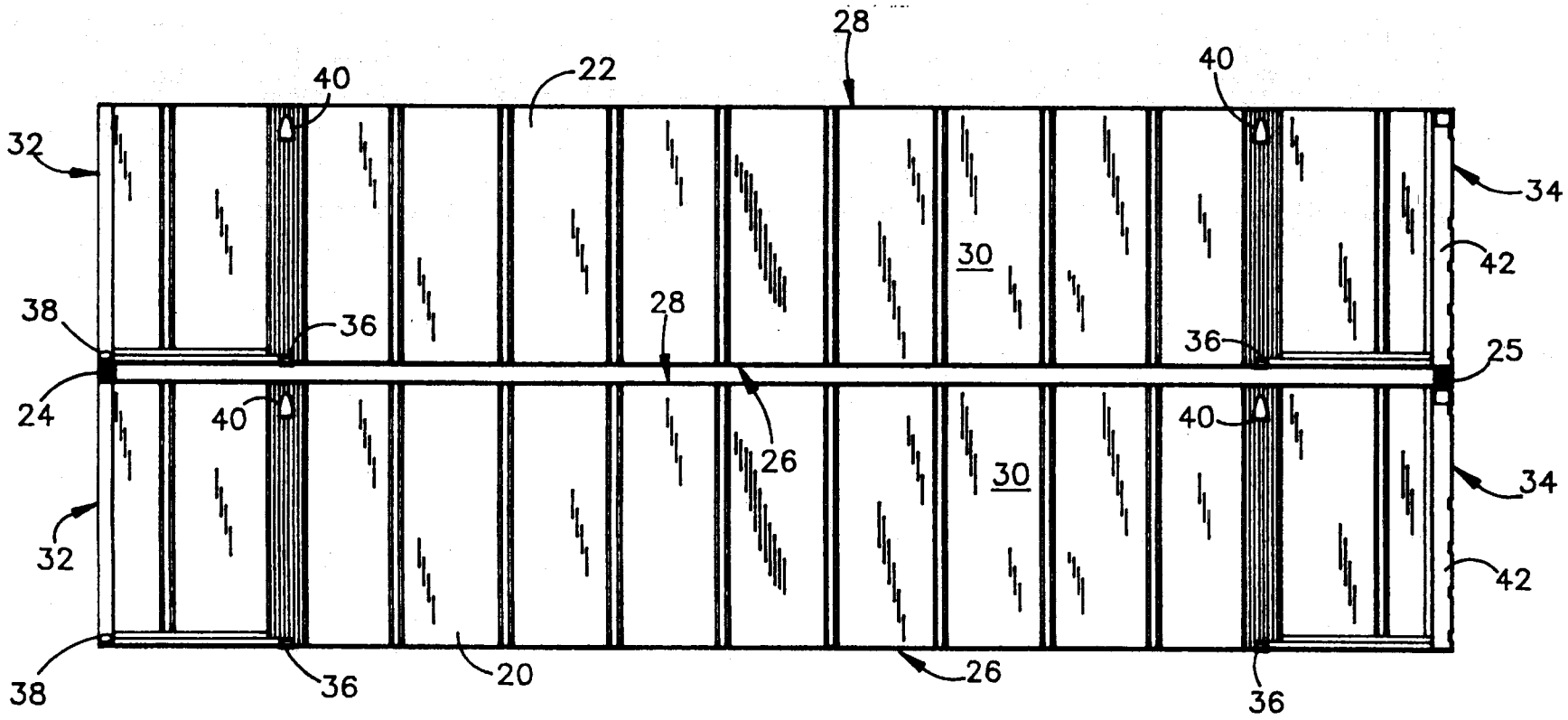
FIG. 1 is a side elevational view showing two containers, stacked one on the other, employing the integrated interbox connectors of the present invention.
Figure 3:
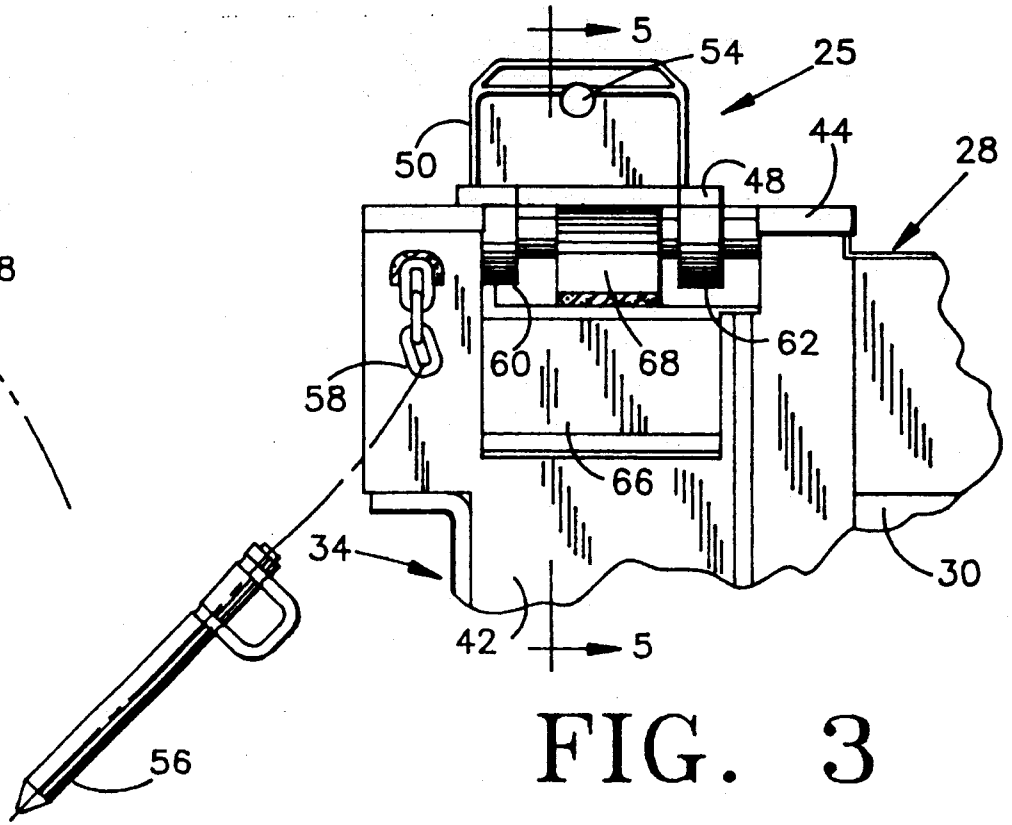
FIG. 3 is a side elevation view of the right side of FIG. 2.
Figure 2:
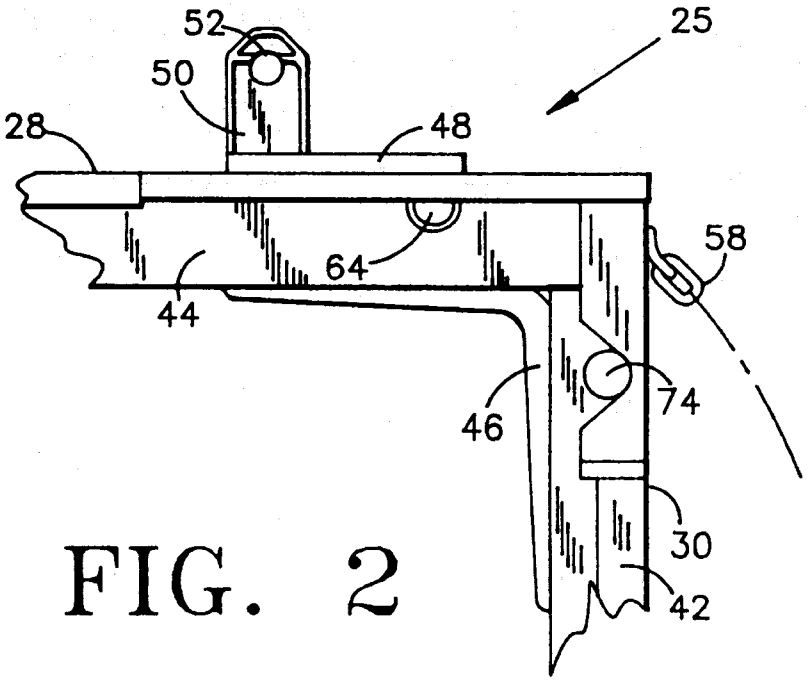
FIG. 2 is an elevation view of the upper right corner of the rear and of an intermodal cargo container or other cargo carrier incorporating a first embodiment of an integrated interbox connector of the present invention.

Two intermodal cargo containers 20 and 22 are shown in FIG. 1 stacked together employing the integrated interbox connectors 24 and 25 of the present invention. Each of the intermodal cargo containers 20 and 22 comprises a space enclosing structure which includes a floor 26, a roof 28 and parallel side walls 30. The containers 20 and 22 include a front end 32 and a rear end 34. The rear end 34 includes an opening to permit entry and exit of cargo, the opening being secured by doors (not shown).

Stacking/interlocking apertures 36 are provided in the floor 26 of the containers 20 and 22 to permit stacking of the containers with conventional 40 foot length containers, or similar structures spaced at the conventional 40 foot distance. Chassis interlocking castings 38 having apertures are provided in the outermost corners of the floor 26 to permit locking of the container to a wheeled chassis for transportation in a truck mode.

Side top lifting apertures 40 are provided to receive pin or wedge type lift elements for lifting the intermodal cargo containers to permit assembly and disassembly of the various transportation mode schemes. The integrated interbox connectors 24 and 25 of the present invention are shown in FIG. 1 to cooperate with downwardly facing openings included in the chassis interlocking castings at the lower corners of the container 22.

FIGS. 2–6 detail a first preferred structure for an integrated interbox connector 25 of the present invention used on the rear end 34 of the container. A rear corner post 42 extends from the floor 26 to the roof 28 of the container and is joined to the top rear header 44. An L-shaped bracket 46 reinforces the connection between the rear corner post 42 and top rear header 44.

Figure 6:
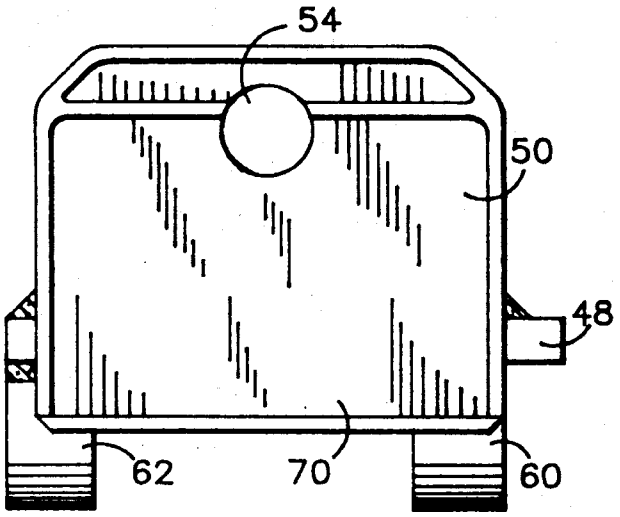
FIG. 6 is a side elevation view of the interbox connector weldment viewed from the opposite side of the view shown in FIG. 3.
Figure 4:
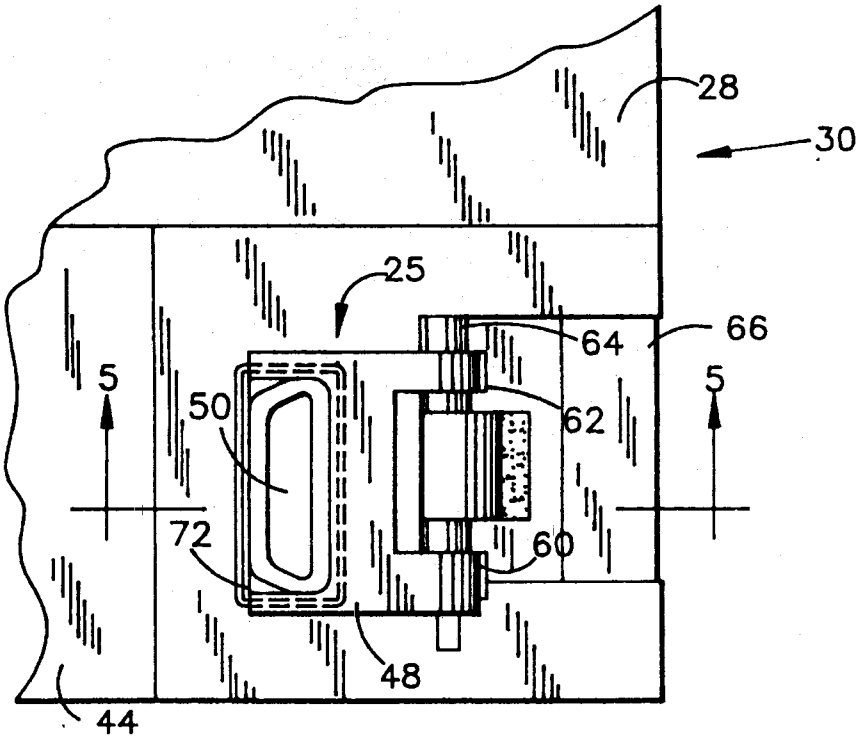
FIG. 4 is a top plan view of the integrated interbox connectors shown in FIGS. 2 and 3.
Figure 5:
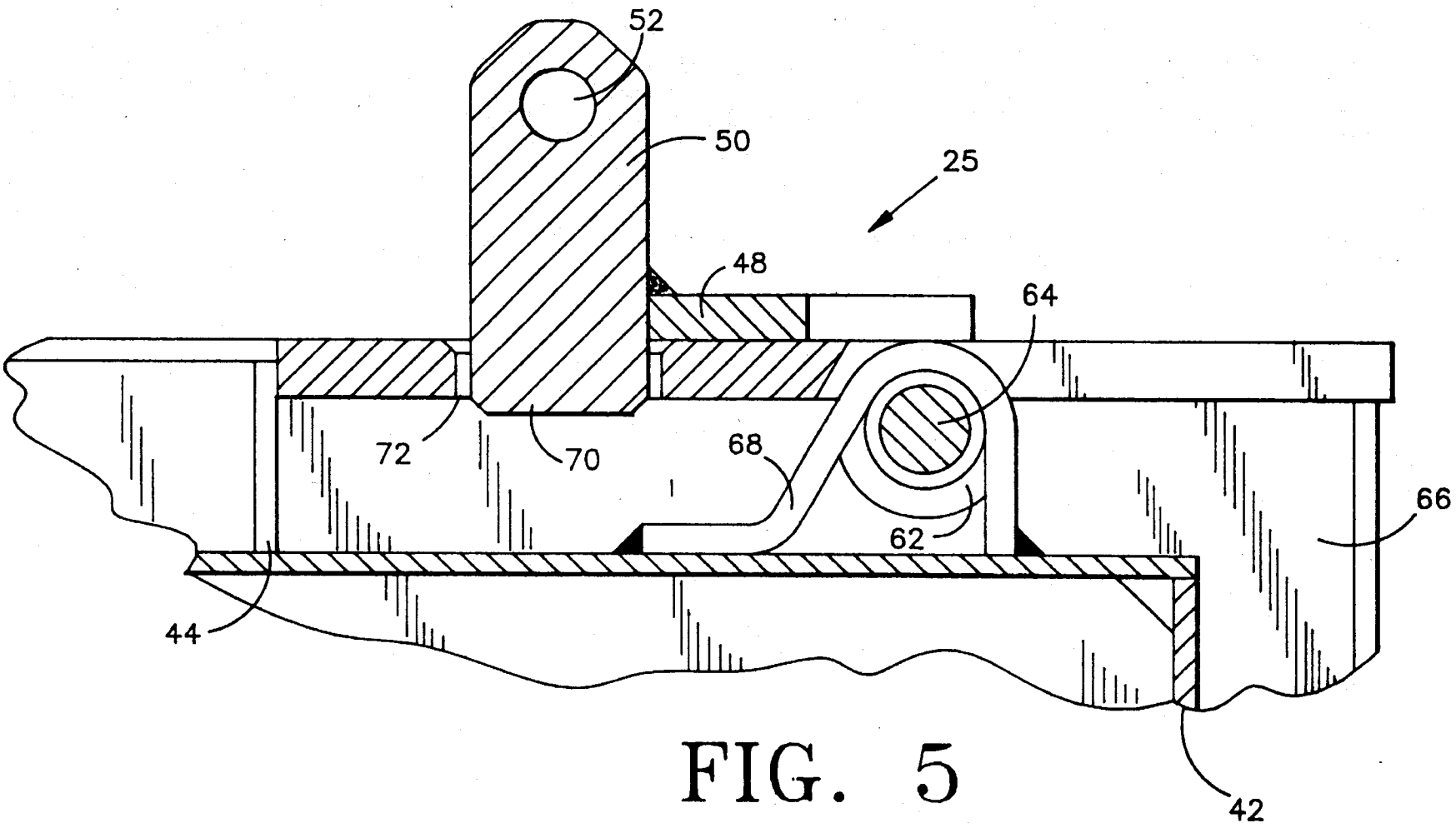
FIG. 5 is a sectional detail view taken along lines 5—5 shown in FIGS. 3 and 4.

The integrated interbox connector 25 shown to include a flat plate 48 to which is fixed an upwardly projecting lug 50 intended to be received in a downwardly facing chassis interlock aperture present in the rear sill of a vertically adjacent intermodal cargo container 22. The projecting lug 50 includes openings 52 and 54 which are sized and adapted to receive pin 56 which is secured to the upper end of the rear corner post 40 by chain 58. The projecting lug 50 includes a lower portion 70 as shown in FIGS. 5 and 6 defining a positioning lug which is adapted to be received in a positioning opening 72 as shown in FIGS. 4 and 5 to insure correct placement of the integrated interbox connector 25 for stacking.

A pair of collars 60 and 62 are fixed to plate 48 to define hinge elements adapted to receive hinge pin 64 which defines an axis of rotation about which the integrated interbox connector plate 48 and lug 50 rotate from the position shown in FIGS. 2–5 to a stored position in storage space 66. The pivot pin 64 is fixed to the top rear header 44 by pivot bracket 68. When not in use, the integrated interbox connecting plate 48 is displaced slightly forwardly and pivoted into the storage space 66. The pin 56 can then be inserted through opening 74 in the rear corner post 42 and into hole 52 to secure the integrated interbox connector 25 in the stored position within the outside geometry of the container.

FIGS. 7–10 illustrate the front integrated interbox connector 24 used at the front end 32 of the containers. The integrated interbox connector 24 comprises a plate 80 to which an upwardly projecting lug 82 is fixed and intended to be received in a downwardly facing opening in lower front casting 38. The lug 82 includes openings 84 and 86 adapted to receive locking pin 88 which is secured to the container by chain 90 fixed to an L-shaped bracket 92. The locking pin 88 includes a locking tab 89 for locking the pin 88 to a vertically adjacent container.

Figure 8:
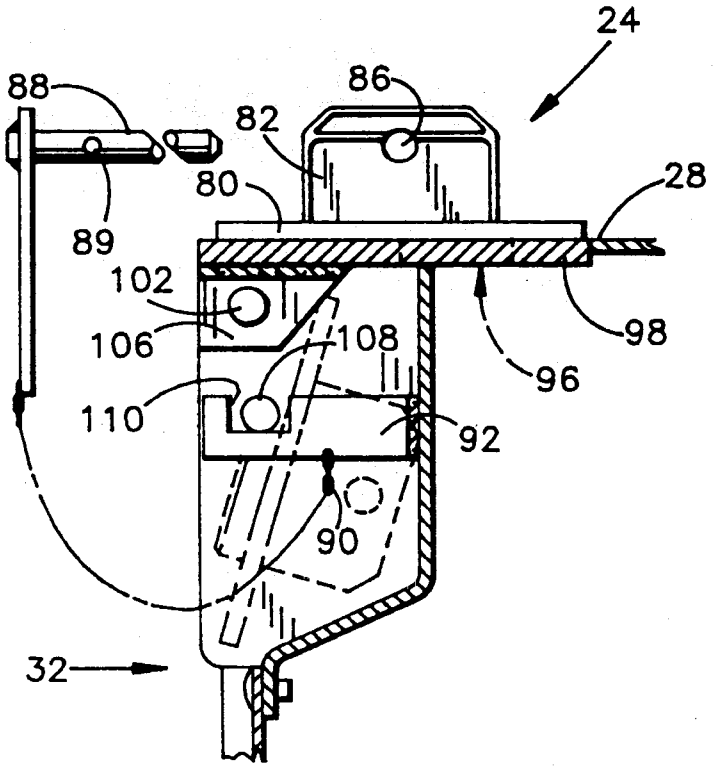
FIG. 8 is a sectional view taken along lines 8—8 of FIG. 7.
Figure 7:
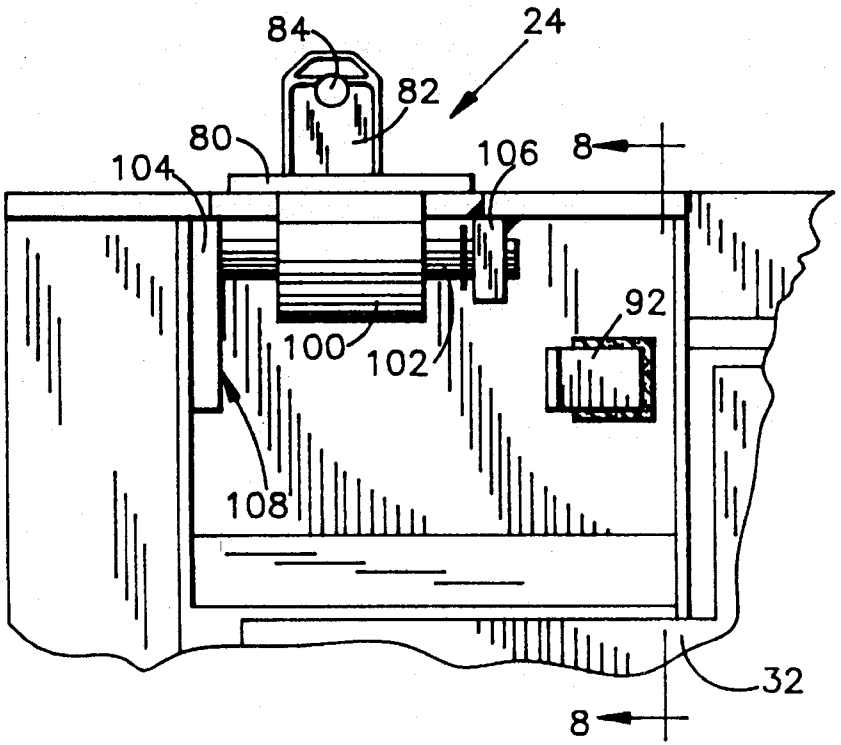
FIG. 7 is an elevation view of the upper left corner of the front of an intermodal container or other cargo carrier having an integrated interbox connector in accordance with the first embodiment of the present invention.
Figure 10:
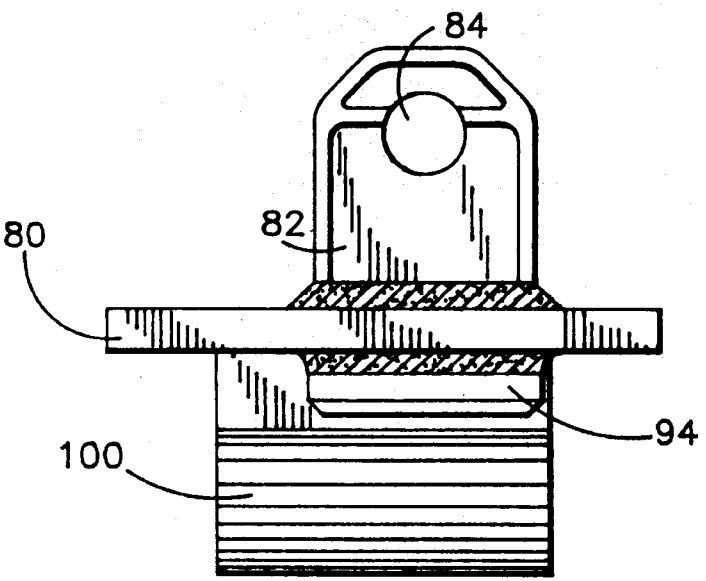
FIG. 10 is an elevational view of the weldment shown in FIG. 9 as viewed from the right side of FIG. 9.
Figure 9:
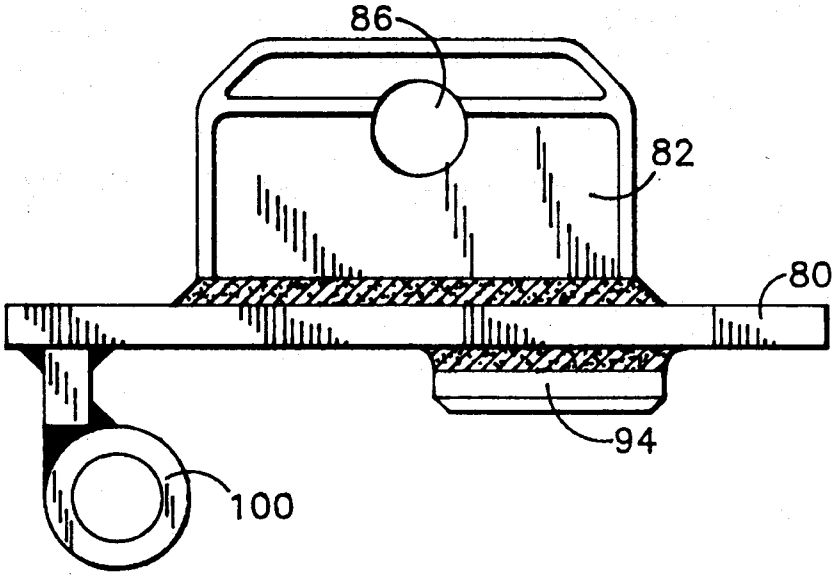
FIG. 9 is an elevational view of the interbox connector weldment shown in FIG. 8.

As shown in FIGS. 9 and 10, the interbox connector weldment includes a lower lug 94 which is adapted to be received in a positioning opening 96 in the top front header 98 which opening is shown in phantom in FIG. 8. The plate 80 is fixed to collar 100 which receives pivot pin 102 to define the hinge point about which the interbox connector 24 pivots from a stacking or use position, shown in FIG. 8 in full, to a storage position, shown in FIG. 8 in phantom. The axis of the hinge pin 102 is defined by hinge brackets 104 and 106. When the interbox connector is pivoted to its storage position shown in phantom in FIG. 8, the interbox connector is retained in that position by insertion of one end of pin 88 into opening 108 in a lower portion of bracket 104 and notch 110 in L-shaped bracket 92.

Figure 11:
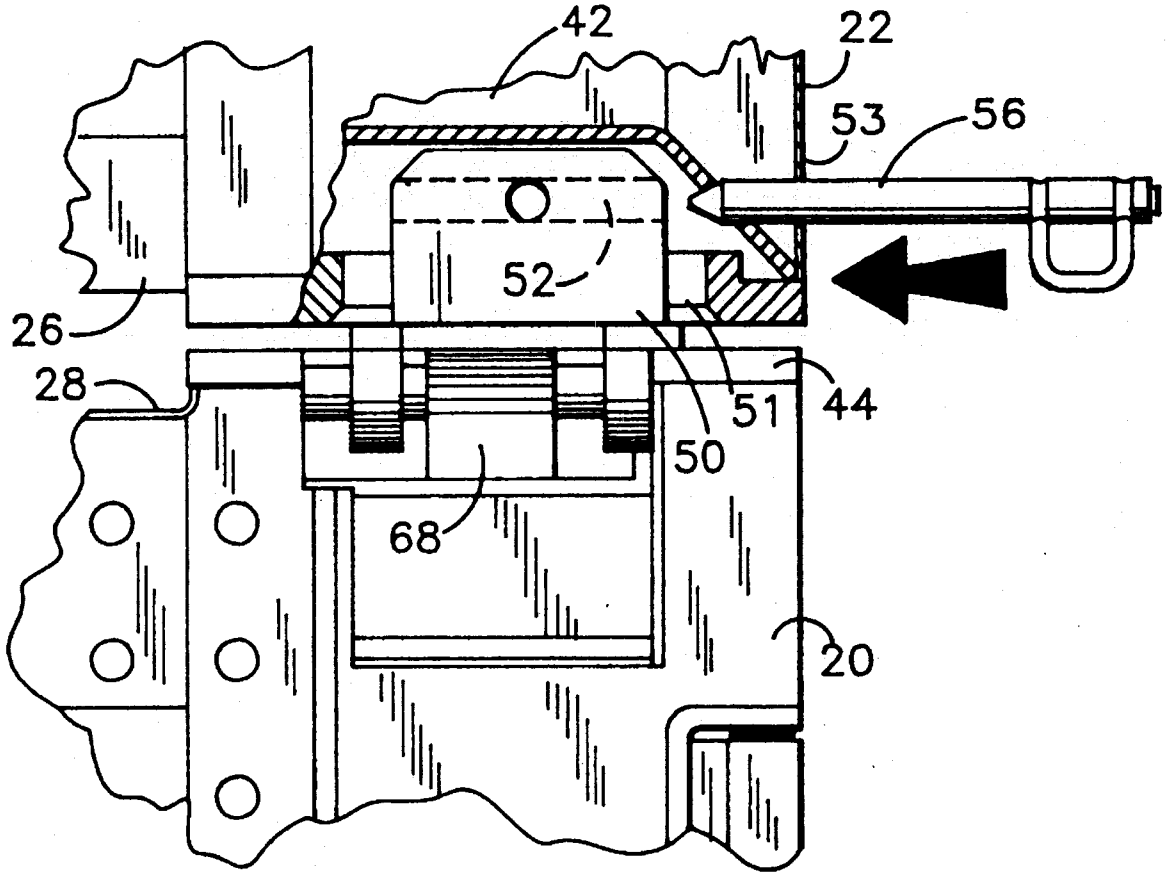
FIG. 11 is a side elevation view showing a rear integrated box connector coupled to a vertically adjacent container.
Figure 12:
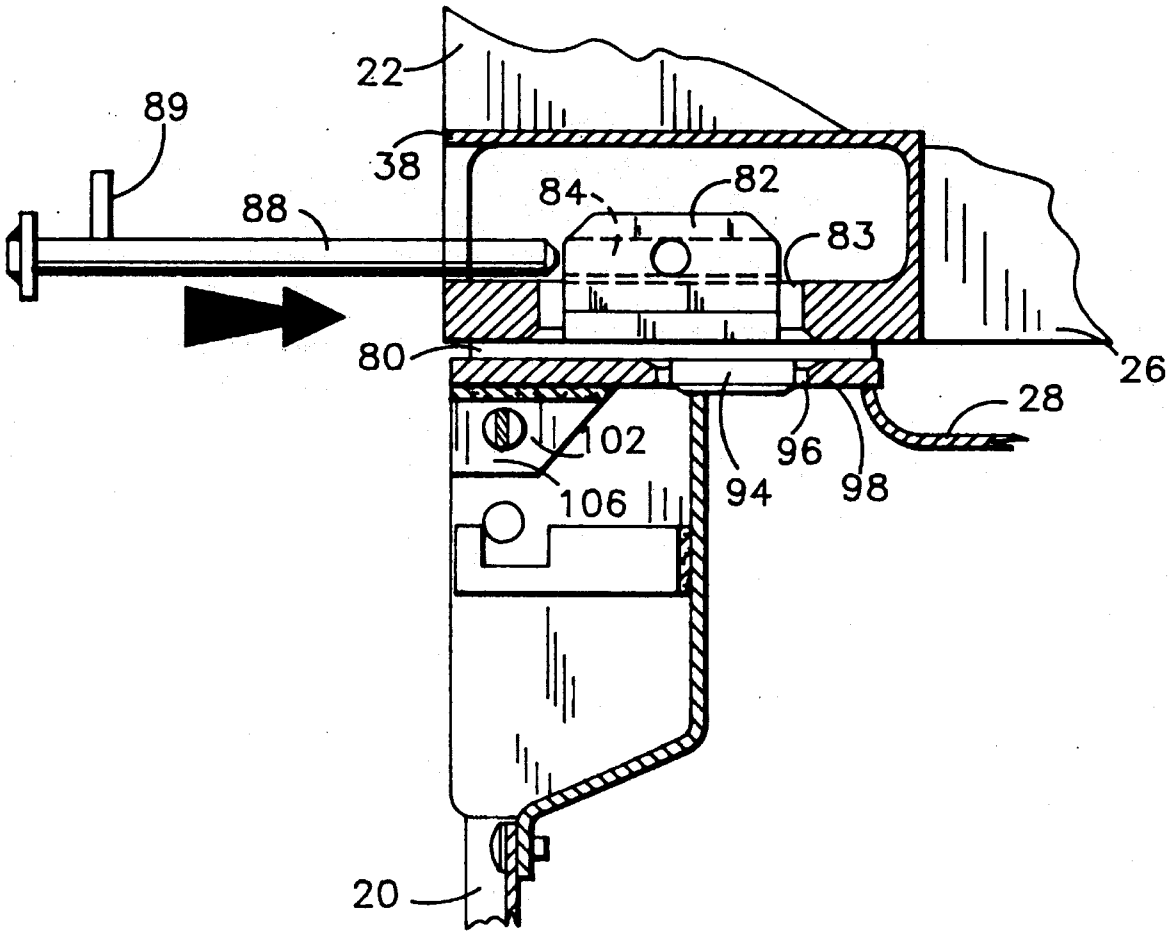
FIG. 12 is a sectional view showing a front integrated box connector coupled to a vertically adjacent container.
Figure 13:
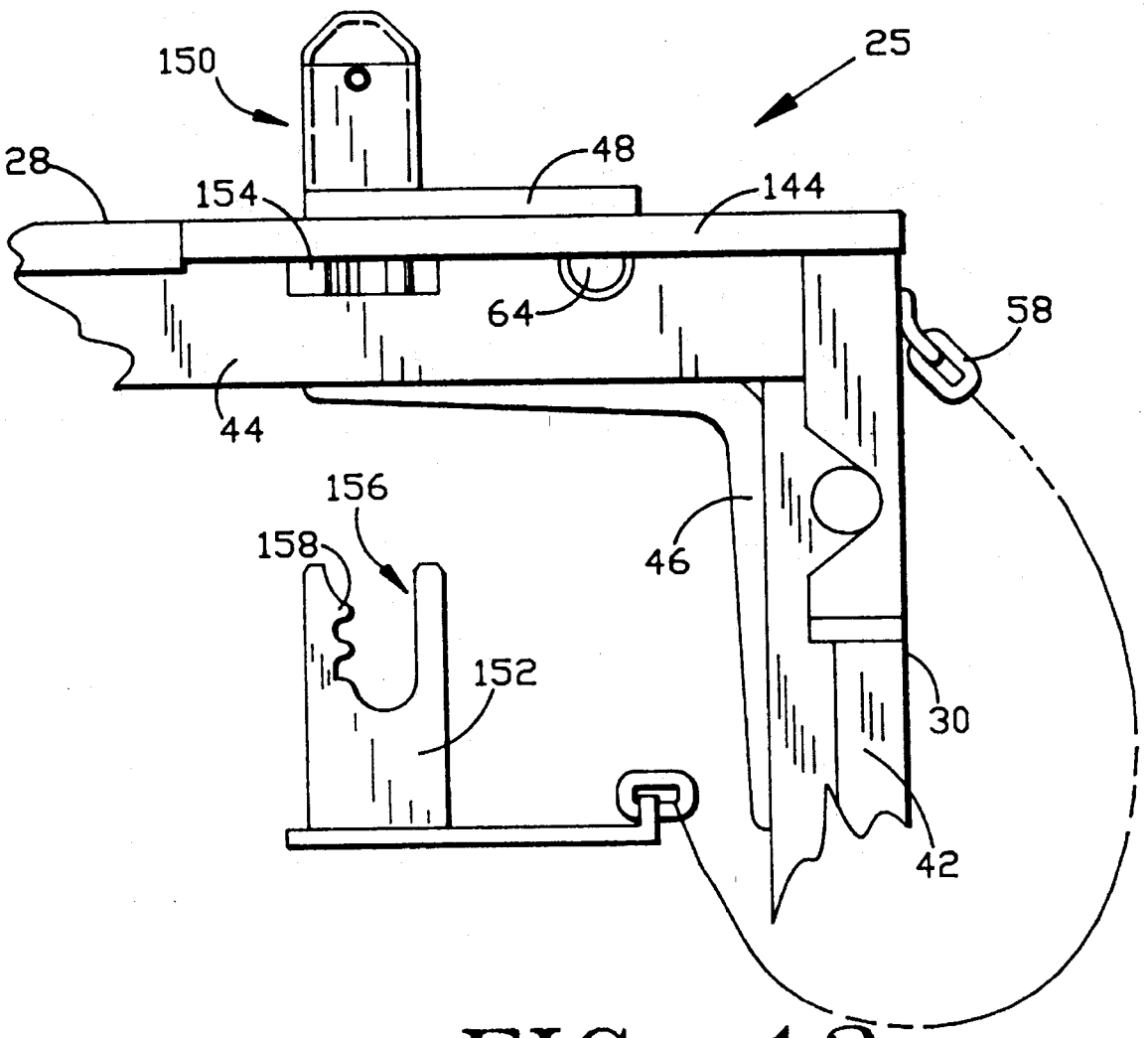
FIG. 13 is an elevation view similar to FIG. 2 showing a second embodiment of an integrated interbox connector in accordance with the present invention with the rotatable projecting lug situated in the unlocked position.

As shown in FIG. 11, the upwardly projecting lug 50 of rear interbox connector 25 is received in a downwardly facing rear chassis interlock aperture 51 present in the rear sill 53 of a vertically adjacent intermodal cargo container 22. The projecting lug 50 includes an opening 52 which is sized and adapted to receive pin 56 through a whole in the rear sill 53 of container 22. The upwardly projecting lug 82 of front interbox connector 24 is shown in FIG. 12 to be received in a downwardly facing opening 83 in lower front casting 38. The lug 82 includes an opening 84 adapted to receive locking pin 88 which includes a locking tab 89 for locking the pin 88 to a vertically adjacent container.

While the first embodiment of the present invention employs fixed lugs 50 and 82, it will be appreciated that rotatable lugs could also be employed to enhance the interlocking engagement between the interbox connector lugs and the openings provided in the vertically adjacent container. FIGS. 13–16 detail another embodiment of the invention employing such a rotatable lug 150 together with a securing means such as locking tab 152 which is received in slot 154 immediately below top header plate 144 for securing the interbox connector to a vertically adjacent cargo carrier. The locking tab 152 includes a slot 156 having cogs 158 which engage positioning gear 160 on pin 162 shown in detail in FIGS. 15 and 16. The locking tab 152 includes a handle 164 facilitating the insertion and withdrawal of the locking tab. The locking tab handle 164 is preferably connected to the cargo carrier by chain 58.

Figure 14:
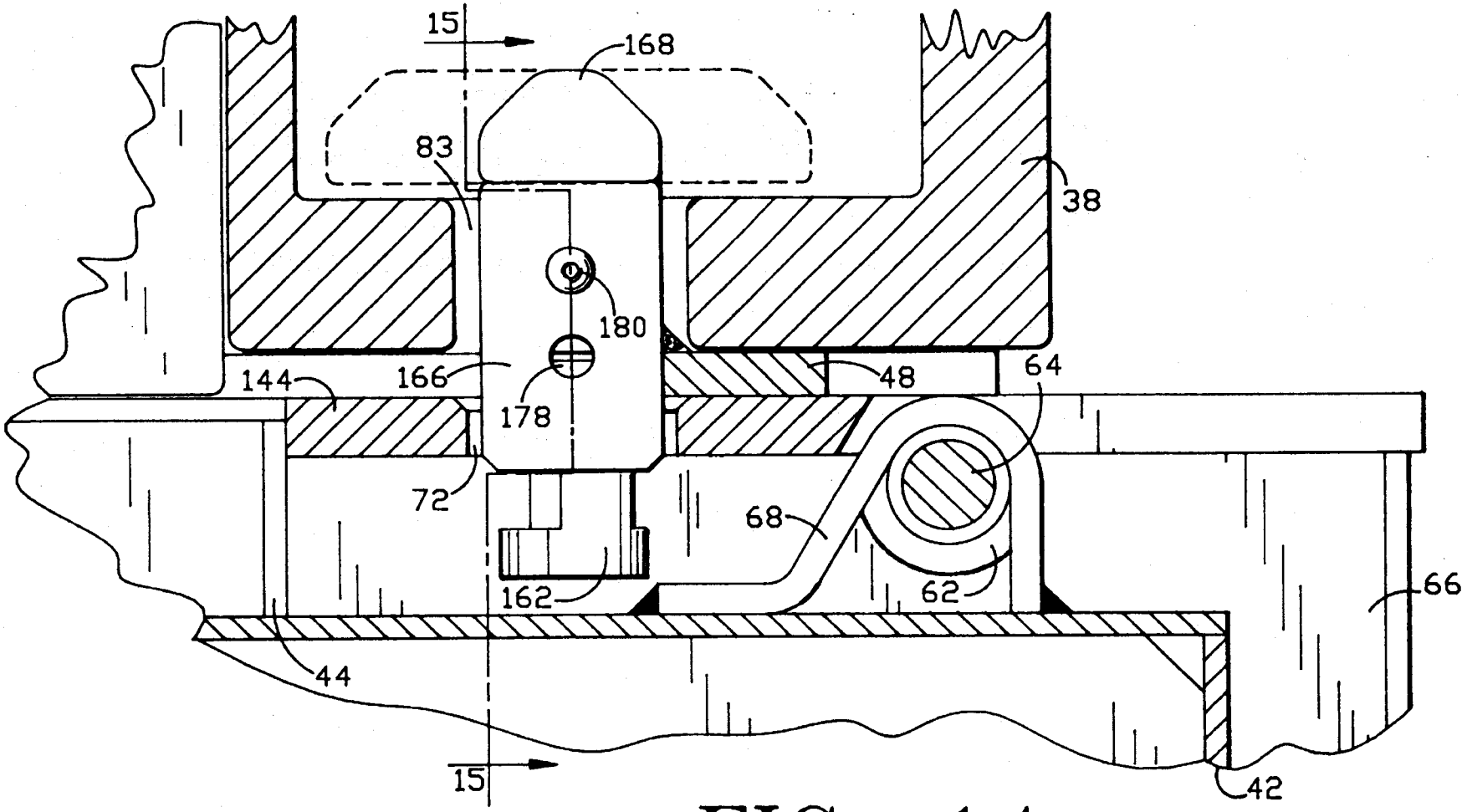
FIG. 14 is a detail view partially in section similar to FIG. 5 showing the second embodiment of the present invention with the projecting lug rotated to the locked position.
Figure 16:
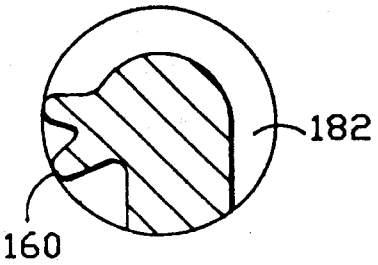
FIG. 16 is a sectional view taken along line 16—16 from FIG. 15.
Figure 15:
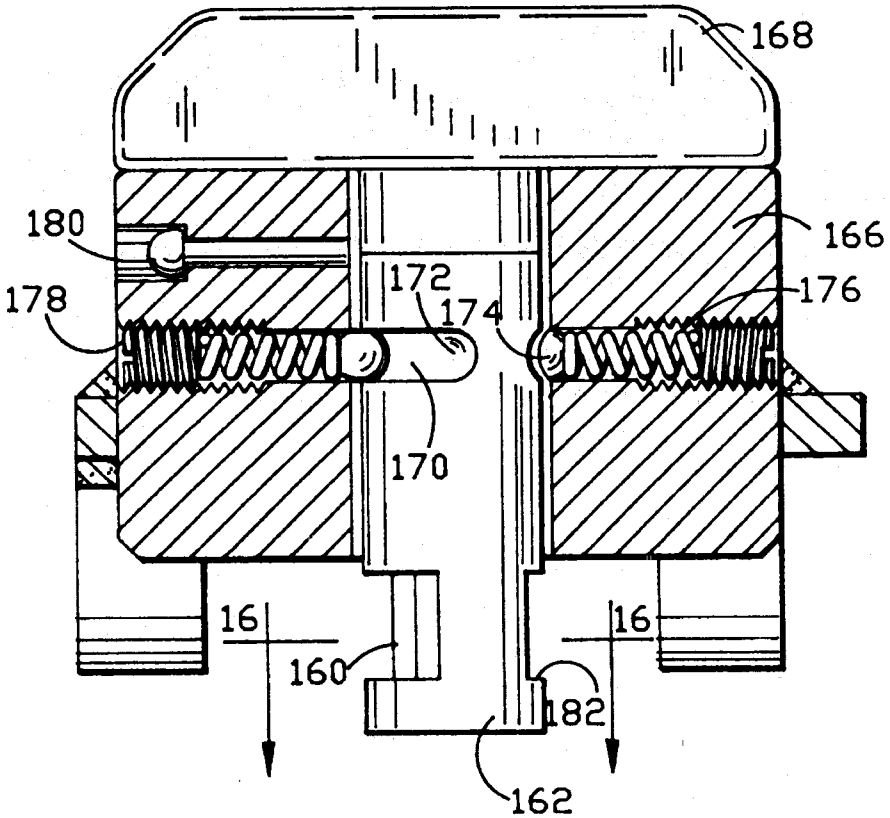
FIG. 15 is a detail view partially in section taken along line 15—15 from FIG. 14.

The lug 150 is shown in FIGS. 14 and 15 to include a collar 166 fixed to interbox connector plate 48 which is in turn hinged to top header by pivot pin 64 as previously described in connection with FIGS. 2–6. The lug 150 also includes a top rotatable portion 168 fixed to rotatable pin 162 which is rotatable between an unlocked position shown in solid lines in FIG. 14, in which the portion 168 is aligned with the opening 83, and a locked position shown in phantom, in which portion 168 is anti-aligned with the opening 83, whereby the lower casting 38 of the vertically adjacent cargo container is engaged. The pin 162 includes a circumferential groove 170 including end depressions 172. The groove 170 receives balls 174 or other similar projecting elements which are biased by springs 176 thereby limiting the movement of the pin 162 within the collar 166. The compression force exerted by the springs 176 can be adjusted by set screws 178. The collar 166 includes a grease fitting 180 for providing lubricant. The ledge 182 at the lower end of positioning gear 160 interacts with the lower surface of locking tab 152 to assist in preventing any undesirable upward movement of pin 162 when the lug 152 is in the locked position.

Intermediate integrated interbox connectors similar to the rear connectors 25 could be employed at the 40 foot intermediate position, if combined with an appropriate stacking frame, to permit stacking of a smaller length container on top of an extended container as shown. Such intermediate integrated interbox connectors would not intrude significantly into the cargo space of the intermodal container or other cargo carrier incorporating them.

Although the invention has been described in detail with reference to the illustrated preferred embodiment, other variations and modifications exist within the scope and spirit of the invention as described and as defined in the following claims.

What is claimed:

1. Apparatus for engaging interlocking apertures provided on the bottom of cargo carriers to permit vertical stacking of the carriers, the cargo carriers also having a floor, a roof, a pair of parallel side walls, and first and second end walls respectively connected between the side walls defining a space enclosing structure, with at least one of the side walls and end walls defining an opening therethrough to permit entry and exit of cargo, the apparatus comprising integrated interbox connectors movably connected to the carrier and positionable between in a stored position situated within the space enclosing structure of the carrier and a connecting position situated on top of the roof of the carrier, each integrated interbox connector including a rotatable projecting lug for engaging the interlocking apertures of a vertically adjacent carrier, and securing means for securing the interbox connectors situated in the connecting position to said interlocking apertures provided on the bottom of said vertically adjacent carrier including means for rotating the rotatable head.

2. The apparatus of claim 1 wherein each of said integrated interbox connectors includes a plate, the rotatable projecting lug being rotatable with respect to the plate to an unlocked position aligned with said interlocking aperture to project into said interlocking apertures of said vertically adjacent carrier and a rotation pin fixed to the projecting lug and extending through the plate.

3. The apparatus of claim 2 wherein each of said integrated interbox connectors includes a first hinge element fixed to said plate, a second hinge element fixed to said carrier to permit pivotal displacement of the connector between said stored position and said connecting position, and a hinge pin coupling the first hinge element and the second hinge element.

4. The apparatus of claim 2 wherein each of said integrated interbox connectors further includes a collar fixed to the plate and spacing the rotatable projecting lug from the plate, the rotation pin extending through the collard and restricting means situated within the collar for restricting the movement of the rotation pin.

5. The apparatus of claim 4 wherein said restricting means comprises a groove in an outer surface of said rotation pin and a projecting element biased into the groove by a spring situated within the collar.

6. The apparatus of claim 2 wherein the securing means comprises a positioning gear fixed to the rotation pin for rotating the pin and projecting lug to a locked position anti-aligned with said interlocking aperture of said vertically adjacent carrier.

7. The apparatus of claim 6 wherein the roof of the cargo carrier adjacent each of said integrated interbox connectors includes a top plate having a positioning opening, the positioning gear being received through said opening when the integrated interbox connector is positioned in said connecting position.

8. The apparatus of claim 7 wherein said securing means comprises a cog engaging the gear below said top plate containing the positioning opening to rotate the pin and projecting lug to said locked position.

9. The apparatus of claim 8 wherein said securing means further comprises a locking tab having a slot including said cog, the locking tab being slidably received below said top plate having the positioning opening to retain said integrated interbox connector in said connecting position.

10. The apparatus of claim 9 wherein a wall adjacent each of said integrated interbox connectors includes an opening for receiving said locking tab, the insertion of said locking tab causing a rotation of said gear, rotation pin and projecting lug.

11. Apparatus for engaging interlocking apertures provided on the bottom of cargo carriers to permit vertical stacking of the carriers, the cargo carriers also having a floor, a roof, a pair of parallel side walls, and first and second end walls respectively connected between the side walls defining a space enclosing structure, with at least one of the side walls and end walls defining an opening therethrough to permit entry and exit of cargo, the apparatus comprising integrated interbox connectors movably connected to the carrier and positionable between in a stored position situated within the space enclosing structure of the carrier and a connecting position situated on top of the roof of the carrier, each integrated interbox connector including a plate, a first hinge element fixed to said plate, a second hinge element fixed to said carrier to permit pivotal displacement of the connector between said stored position and said connecting position, a hinge pin coupling the first hinge element and the second hinge element, a rotatable projecting lug rotatable with respect to the plate to an unlocked position aligned with said interlocking aperture to project into said interlocking aperture of said vertically adjacent carrier and a rotation pin fixed to the projecting lug and extending through the plate for engaging the interlocking apertures of a vertically adjacent carrier, and securing means for securing the interbox connectors situated in the connecting position to said interlocking apertures provided on the bottom of said vertically adjacent carrier including a positioning gear fixed to the rotation pin for rotating the pin and projecting lug to a locked position anti-aligned with said interlocking aperture of said vertically adjacent carrier.

12. The apparatus of claim 11 wherein each of said integrated interbox connectors further includes a collar fixed to the plate and spacing the rotatable projecting lug from the plate, the rotation pin extending through the collar, a groove in an outer surface of said rotation pin, and a projecting element biased into the groove by a spring situated within the collar for restricting the movement of the rotation pin.

13. The apparatus of claim 11 wherein the roof of the cargo carrier adjacent each of said integrated interbox connectors includes a top plate having a positioning opening, the positioning gear being received through said opening when the integrated interbox connector is positioned in said connecting position, and wherein said securing means comprises a cog engaging the gear below said top plate containing the positioning opening to rotate the pin and projecting lug to said locked position.

14. The apparatus of claim 13 wherein said securing means further comprises a locking tab having a slot including said cog, the locking tab being slidably received below said top plate having the positioning opening to retain said integrated interbox connector in said connecting position.

15. The apparatus of claim 14 wherein a wall adjacent each of said integrated interbox connectors includes an opening for receiving said locking tab, the insertion of said locking tab causing a rotation of said gear, rotation pin and projecting lug.

16. Apparatus for incorporation into a cargo carrier to permit vertically interlocked stacking of two cargo carriers, the apparatus comprising: a plate, connecting means for movably connecting the plate to the cargo carrier top to permit displacement of the plate between in a stored position situated within a wall of the carrier and a connecting position situated on top of the carrier, a rotatable projecting lug rotatable with respect to the plate between an unlocked position aligned with an interlocking aperture of a vertically adjacent cargo carrier and a locked position anti-aligned with said interlocking aperture of said vertically adjacent carrier, and rotation means for rotating the rotatable projecting lug between said positions.

17. The apparatus of claim 16 wherein the connecting means permitting movement of the plate between the stored position and the connecting position includes a first hinge element fixed to said plate, a second hinge element to be fixed to said carrier to permit pivotal displacement of the plate, and a hinge pin coupling the first hinge element and the second hinge element.

18. The apparatus of claim 16 wherein the rotation means comprises a rotation pin fixed to the projecting lug and extending through the plate, a positioning gear fixed to the rotation pin, and a locking tab having a slot including a cog for engaging the positioning gear, the locking tab being slidably received around the rotation pin.

19. The apparatus of claim 18 further comprising a collar fixed to the plate and spacing the rotatable projecting lug from the plate, the rotation pin extending through the collar, and restricting means situated within the collar for restricting the movement of the rotation pin.

20. The apparatus of claim 19 wherein said restricting means comprises a groove in an outer surface of said rotation pin and a projecting element biased into the groove by a spring situated within the collar.

* * * * *